US005897305A

United States Patent [19]

Roddis

[11] Patent Number: 5,897,305

[45] Date of Patent: Apr. 27, 1999

[54] VALVE ASSEMBLY FOR COMPRESSORS

[76] Inventor: Gravatt Keith Roddis, 217 Moylan Ave., Media, Pa. 19063-6102

[21] Appl. No.: 08/694,101

[22] Filed: Aug. 8, 1996

[51] Int. Cl.[6] ..... F04B 39/00; F16K 15/02

[52] U.S. Cl. ..... 417/566; 137/533.17

[58] Field of Search ..... 417/566, 559, 417/560, 561, 563; 137/533, 533.17

[56] References Cited

U.S. PATENT DOCUMENTS

| | | | |
|---|---|---|---|
| 4,314,797 | 2/1982 | Gerwin | 417/566 X |
| 4,368,755 | 1/1983 | King | 417/566 X |
| 4,385,872 | 5/1983 | Anderson | 417/566 X |
| 4,414,997 | 11/1983 | Jacobson et al. | 137/533.17 X |
| 4,586,910 | 5/1986 | Buchanan | 137/533 X |
| 5,520,522 | 5/1996 | Rathore et al. | 137/533.17 X |

*Primary Examiner*—Ismael Izaguirre
*Attorney, Agent, or Firm*—Eugene E. Renz, Jr.PC

[57] ABSTRACT

A valve assembly positionable between open and closed positions in response to pressure differentials only comprising a valve chamber having an inlet and an outlet defined by a circumferentially extending tapered wall defining a valve seat adjacent the inlet and an outlet wall with at least one port adjacent this outlet. The assembly further comprises a valve element having a truncated frusto conical body portion and an outer peripheral tapered surface complementing the taper of the valve seat and a pad of smaller diameter than the largest diameter of the body portion depending from a large end of the body portion engageable with the outlet wall and displaced from the outlet port to permit flow from the inlet through the outlet when the valve is in the open position.

10 Claims, 7 Drawing Sheets

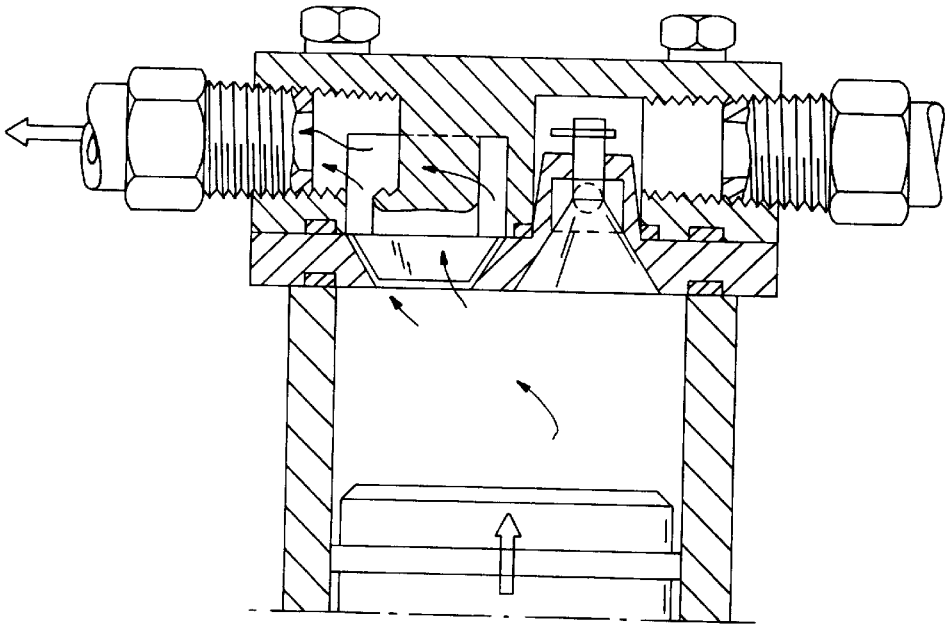
FIG. 13
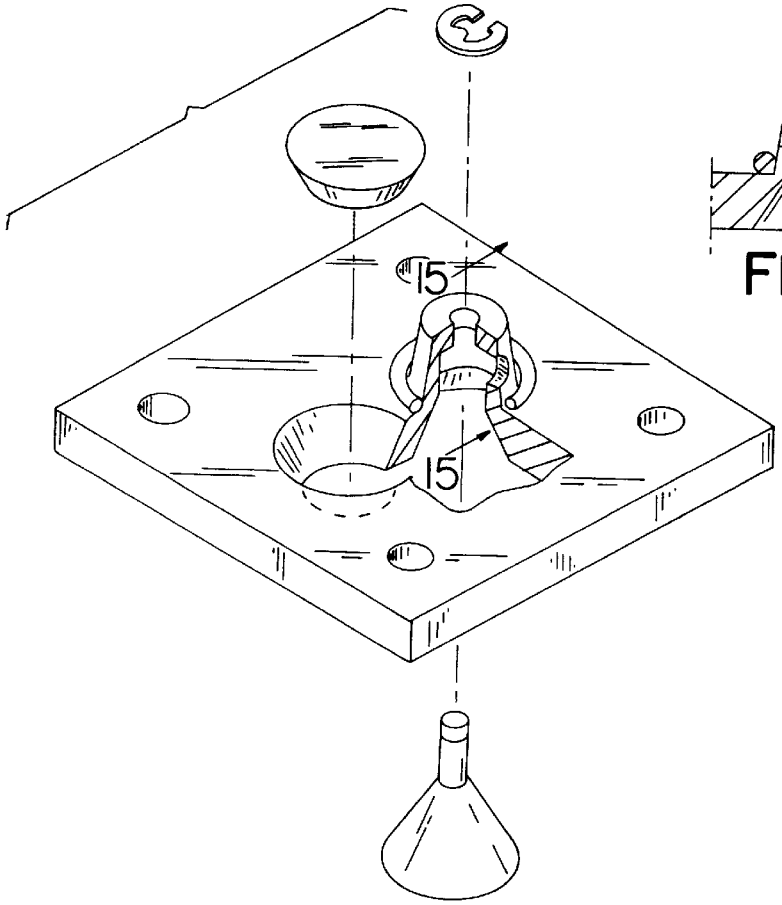
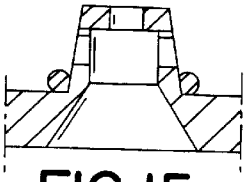
FIG. 15
FIG. 14

VALVE ASSEMBLY FOR COMPRESSORS

BACKGROUND OF THE INVENTION

A typical compressor comprises a crank case having a rotatable crank shaft driven by a prime mover such as a motor. The crank shaft drives a piston in a piston chamber through a connecting rod. The piston is provided with the usual seal to provide a gas and liquid tight seal between the piston and the inner cylinder walls. The outer end of the piston cylinder mounts a cylinder head having inlet and outlet ports which typically transfer gas and/or liquid or combinations of the two from the inlet port through the piston chamber and out the outlet port. For example, the inlet port may be connected by a flexible line to a unit containing a gas/liquid refrigerant and the outlet port is connected through a flexible line to a portable refrigerant storage container or the compressor may be used as one element of a more complicated refrigerant recovery and/or recharging unit. These systems would typically be used to safely drain and/or recharge air conditioning units or other refrigerating devices or apparatus using Chlorinated Fluorocarbons (CFC's), Hydro Chloro Fluorocarbons (HCFC's), Hydro Fluorocarbons (HFC's) or other refrigerants. Typically the cylinder head has an arrangement of valves for controlling flow of refrigerant from the inlet and outlet ports to and from the piston cylinder. Typically these valves are either of the poppet type or reed valves.

It has been found that these systems while generally effective for the purposes intended have certain disadvantages and drawbacks. For example, reeds of a typical reed valve are rather delicate and the spring action of these valves over a period of time may result in fatigue failures. Also due to their delicate nature, the reed valves may not tolerate liquid flow or mixed liquid and gas flow without breaking. When the reeds fail they disrupt normal operation of the compressor and may be ingested into the cylinder. It has been found that in some instances spring biased poppet valves are drawn directly into the piston chamber causing compressor failure and sometimes permanent damage such as scoring of the piston walls or distortion of other parts due to jamming. Another failure mode involves failure of the spring or of the spring keeper details causing loss of compressor function and damage to parts. Repair or replacement of failed or damaged parts is time consuming and expensive. Furthermore in these known designs utilizing springs, the spring forces must be overcome by gas pressure differentials and this reduces the compressor volumetric efficiency and also limits pressure ratio capabilities. Additionally, the springs must be carefully controlled as to their manufactured stiffness, dimensions and other properties as well as their installation.

Pumping systems for pumping gases and fluids are not new per se. Prior art patents of interest include the following:

H. J. Berry

PUMP CYLINDER AND VALVES THEREFOR

U.S. Pat. No. 1,476,794

Dated: Dec. 11, 1923

J. D. Nixon

PUMP VALVE MECHANISM

U.S. Pat. No. 1,873,762

Dated: Aug. 23, 1932

G. K. Steward

INTERNAL COMBUSTION ENGINE

U.S. Pat. No. 2,153,598

Dated: Apr. 11, 1939

T. W. Crowell

LIQUID FUEL OR LUBRICANT SUPPLY TANK

U.S. Pat. No. 2,320,913

Dated: Jun. 1, 1943

J. I. Bevan

FLUID COMPRESSOR COOLING SYSTEM

U.S. Pat. No. 2,504,245

Dated: Apr. 18, 1950

O.H. Buschmann

COMPRESSOR UNLOADER

U.S. Pat. No. 2,520,674

Dated: Aug. 29, 1950

Clyde H. Clement

MULTI-PURPOSE PUMP

U.S. Pat. No. 3,904,326

Dated: Sep. 9, 1975

Donald K. Chalaire

CHECK VALVE

U.S. Pat. No. 4,655,248

Dated: Apr. 7, 1987

Shawn A. Leu

VALVE PLATE WITH A RECESSED VALVE ASSEMBLY

U.S. Pat. No. 5,213,125

Dated: May 25, 1993

Of the patents listed above, Leu Pat. No. 5,213,125 ('125) is a recent state of the art reed type valve design. The points raised above relating to reed valves is applicable to the Leu ('125) valve assembly.

The multi-purpose pump shown in the Clement U.S. Pat. No. 3,904,326 ('326) is of interest to the extent that it shows valve assemblies bearing a superficial resemblance to that of the present invention. However, the fact that the valves utilize springs, the degree of allowed valve travel and the wall configurations are important differences. These differences all affect the performance of the device and would, if constructed as taught by Clement ('326), result in entirely unacceptable performance characteristics for the purpose which the present invention addresses.

The stepped wall configurations within the piston chamber as well as the significant free space within the valve chambers of Clement ('326) embodiment FIG. 3, impair the devices compression ratio. The springs reduce volumetric efficiency, add cost and present failure modes. The valve travel of the present invention is carefully limited to a small amount which is compatible with high speed operation whereas the Clement ('326) application is for a slow speed device. Additionally, the present invention includes a depending pad or its analog in the opposing valve chamber wall to provide a stepped valve configuration, which provides in accordance with the present invention, an outlet flow path from the valve chamber and a quick acting valve having well controlled valve travel. The present invention differs from the embodiment shown in FIG. 5 of Clement ('326) for essentially the same reasons.

SUMMARY OF THE INVENTION

The present invention provides an improved valve assembly particularly adapted for use in compressor assemblies of the type described above and presents an alternative to the use of reed valves and poppet valves and eliminates some of the disadvantages and provides certain advantages. To this end, the valve of the present invention is of generally truncated frusto-conical shape having a short cylindrical depending pad at its large end or its analog in the opposing valve chamber wall and seats in a valve chamber formed in part by a complementary frusto-conical seat, the pad confronting a non moving surface opposite the valve seat and cooperating with at least one port opposite therein. Pressure differentials move the valve between a position engaging the seat to prevent flow through the port and an opposite limit position wherein the pad engages the opposing surface to permit flow between the seat and frusto-conical side wall of the valve element and through the port. The valve is normally in a closed position when the frusto-conical surface of the valve element and the frusto-conical seat are engaged and is in an open position when they are displaced from one another.

The present design has several advantages over the prior art discussed above. The valve of the present invention is of extremely light weight design and therefore reacts quickly and fully to pressure differentials and changes, for example, when the piston is actuated in a direction to create a vacuum or a pressure in the piston chamber. Additionally, the present valve assembly provides for a closely controlled valve travel between the open and closed positions. This optimizes the compromise between greater valve opening to achieve low fluid resistance and lessor valve opening for fast valve action in high speed compressors.

Since the valve assembly of the present invention does not rely on delicate reeds or utilize springs, the various disadvantages of performance restrictions and of failed parts noted above in connection with reed valves and poppet valves is eliminated. Further, ingestion of the type described above in connection with inlet poppet valves is impossible since the valve of the present invention is incapable of being drawn into the piston chamber.

The present design utilizes fluid pressure differentials to actuate the valve motions without the aid of any springs. This has the multiple advantages of eliminating all cost and failure modes associated with designs utilizing springs to assist the valve motions as noted above.

The valve design of the present invention is simplified and therefore a single design may be utilized for both the inlet and the discharge valve elements in refrigerant compressor assemblies. In other words, the same identical part configuration can be used for both the discharge and the intake valves while retaining the advantage in other design applications of using somewhat different parts to optimize flow requirements. The inlet or discharge valves of the present invention may also be used in respective combination with discharge or inlet valves of other types not of the present invention. For example, a particular design solution may be optimized by using the advantages of only the discharge valve of the present invention while using an inlet valve of some other type. Further, it has been found that high pressure ratios are possible utilizing valves of the present invention. For example, a compressor of a predetermined capacity can create high vacuums and high discharge pressures over a wide range of flow conditions.

Other advantages include the fact that the springs, valve stems and valve spring keeper details of prior designs presented flow restrictions in the flow path which are eliminated in the present design. Further, the valve chamber assembly of the present invention is fully tolerant to a wide range of conditions of gas flow, liquid flow and mixed phase flow of gas and liquid. This is an important requirement for refrigerant applications.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
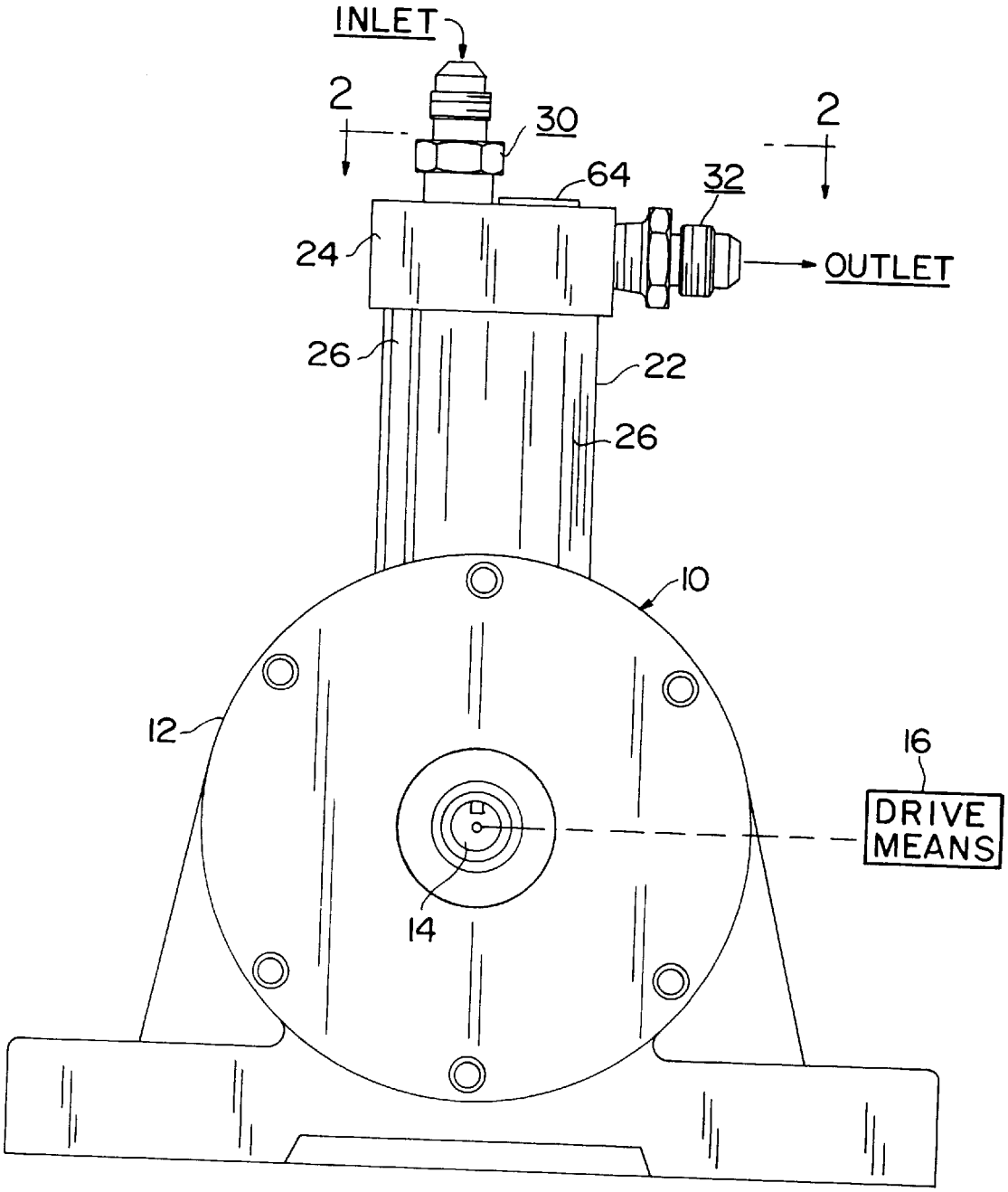
FIG. 1 is a schematic front elevational view of a reciprocating piston type compressor, liquid pump, or vacuum pump incorporating a novel head and valve assembly in accordance with the present invention.
Figure 2:
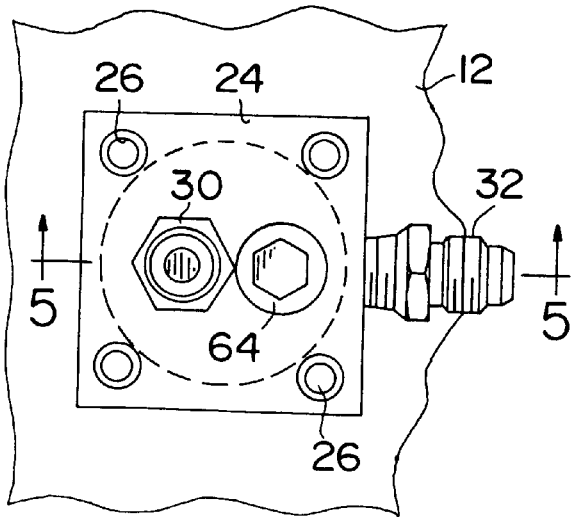
FIG. 2 is a fragmentary plan view taken on lines 2—2 of FIG. 1 showing additional details of the compressor head.
Figure 3:
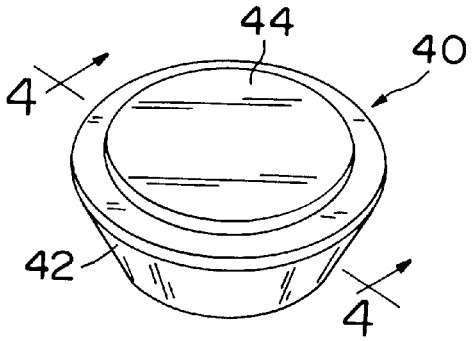
FIG. 3 is a greatly enlarged isometric view of one of the truncated conical disc valves in accordance with the present invention.
Figure 4:
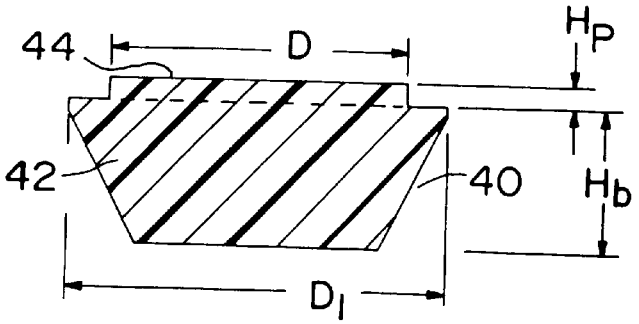
FIG. 4 is an enlarged sectional elevational view taken on lines 4—4 of FIG. 3.

Referring now to the drawings and particularly to FIGS. 1–7 thereof, there is shown a compressor assembly generally designated by the numeral (10) incorporating valve assemblies in accordance with the present invention. The compressor is of generally conventional design overall and includes a crank case or housing (12), a crankshaft (14) rotatably mounted in the housing and connected to a suitable prime mover, such as a motor designated schematically (16). The crankshaft (14) is connected by a connecting rod (not shown) to a reciprocating piston (20) housed in a cylinder (22). A cylinder head (24) having valve chambers is fitted to the upper end of the cylinder (22) by means of bolts (26) and has inlet and outlet fittings (30) and (32) respectively. The inlet fitting (30) is connected by a line to a unit containing a gas or liquid refrigerant to be pumped, such as a CFC and the outlet fitting (32) accommodates a line to discharge the refrigerant. Inlet and outlet valve assemblies (34) and (36) respectively in accordance with the present invention control the flow of refrigerant. Accordingly, on the downward stroke of the piston (20), a suction is created in the piston chamber $C_p$ to draw refrigerant into the piston chamber and on the upward stroke of the piston (20), the valve element of inlet valve assembly (34) closes and the valve element of outlet valve assembly (36) opens to permit delivery of the refrigerant to the outlet line via the fitting (32).

A valve assembly in accordance with the present invention and with particular reference to FIGS. 3–7 inclusive, comprises a valve element generally designated by the numeral (40) preferably made of a lightweight plastic material having a truncated conical body portion (42) and may have an axial aligned cylindrical disc shaped pad (44) integral with the body portion (42) extending outwardly from the base of the truncated body portion and of smaller diameter D than the base of conical portion (42) and of a height $H_p$ to about one sixth (⅙) the body portion height $H_b$. In the present instance, the pad (44) is of a diameter D less than the largest diameter $D_1$ of the body portion.

Figure 5:
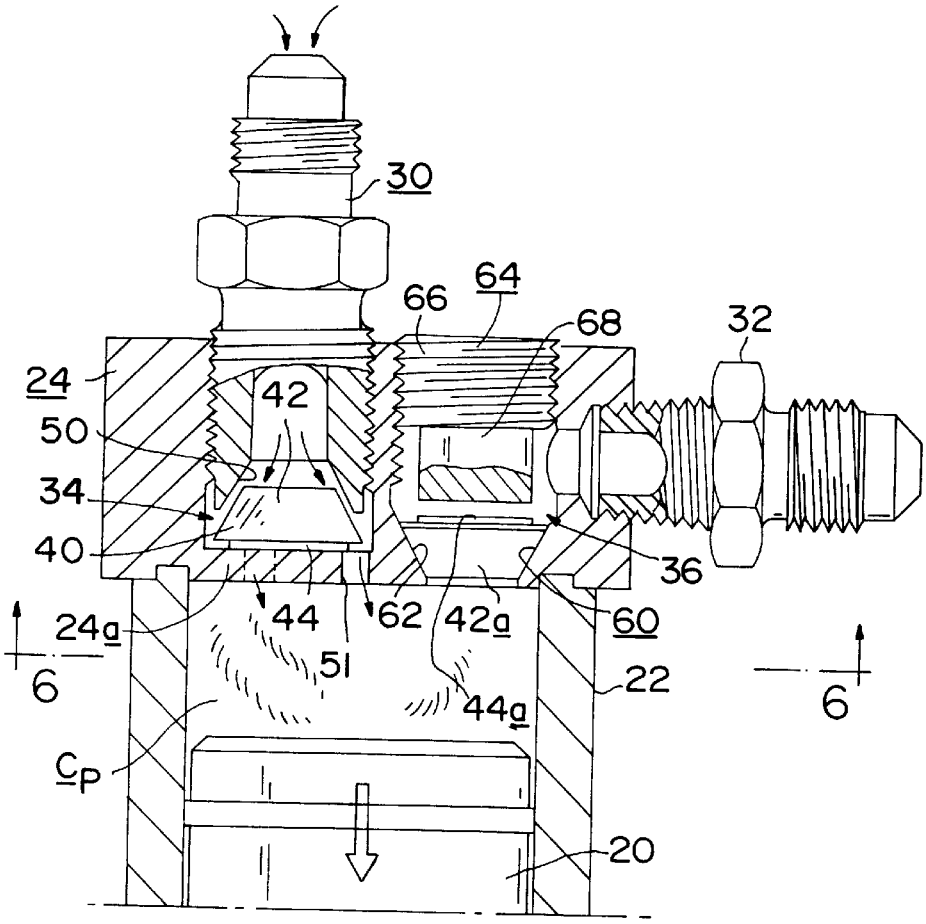
FIG. 5 is an enlarged fragmentary sectional elevational view taken on lines 5—5 of FIG. 2 showing details of the compressor head and truncated conical disc, inlet and outlet valve assemblies. In the view illustrated the inlet and outlet valves are shown during the intake or downward or suction stroke of the piston.
Figure 6:
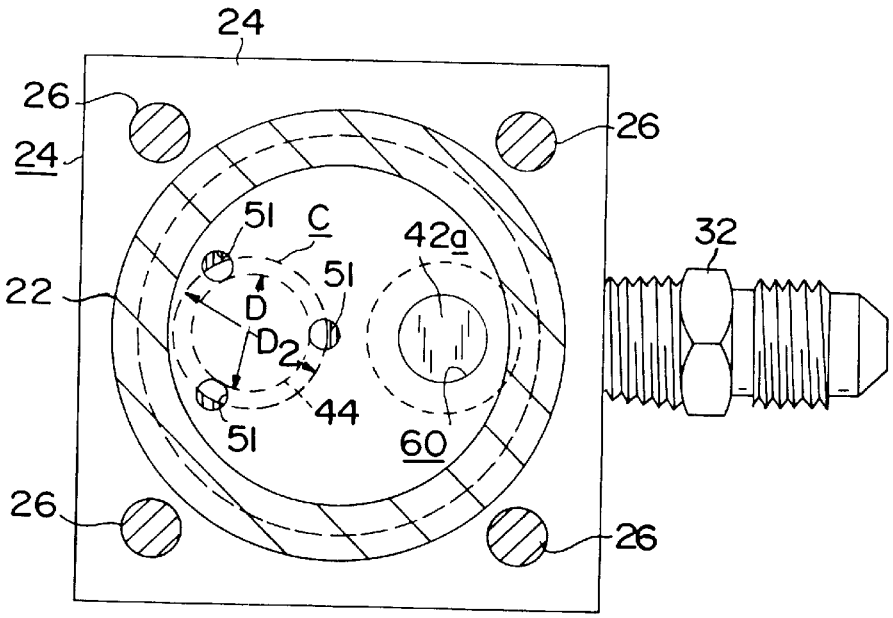
FIG. 6 is a bottom sectional plan view taken on lines 6—6 of FIG. 5 showing additional details of the inlet and outlet valves.

The inlet fitting (30) is threadedly engaged in the cylinder head (24) in the manner shown in FIG. 5 and has a frusto-conical outwardly tapered wall adjacent its inner end thereof defining a valve seat (50). The tapered peripheral surface (42) of the valve element complements the taper of the valve seat (50) so that when they are engaged the valve is fully seated in a closed position. A series of circumferentially spaced ports (51) are provided in the piston cylinder head wall ($24_a$) which as illustrated in FIG. 6, are of circular cross section and have centers located on a circle C. The circle C has a diameter $D_2$ which may be greater than the diameter D of the pad (44) of the valve element (40) so that when the valve element is displaced to its open position, the ports (51) are exposed to permit flow. For example, when the piston (20) is cycled to its lowermost position, a reduced pressure is created in the piston cylinder drawing the valve element (40) on the inlet side of the system downwardly so that the pad (44) seats against the wall ($24_a$) and permits flow of gas/liquid through ports (51) into the piston chamber. Simultaneously the outlet valve element **(42*a*) is drawn downwardly to close an outlet port (60) in the cylinder head. The outlet port (60) has a tapered peripheral surface defining a valve seat ($60_a$). The tapered peripheral surface (42) of the valve element complements the taper of the valve seat (60) so that when they are engaged, the valve is fully seated in a closed position (See FIG. 5**).

Considering now the details of the outlet side of the system, the outlet port (60) in the present instance is tapered upwardly and outwardly to define a tapered discharged valve seat (62) which complements the taper of the valve element **(42*a*). The valve element (42*a*), in the present instance, is of the same configuration and structural arrangement as the inlet valve (42) except that it is in an inverted position with the pad (44*a*) projecting upwardly and confronting a plug fitting (64) defining a stop determining the upward limit position of the valve element in the discharge outlet side of the system. The plug (64) as illustrated has a threaded head portion (66) and a depending stem (68) which confronts the pad or platform (44*a*). In the present instance, the outlet fitting (32) is threadedly received in a tapped opening (63) in the sidewall of the cylinder head. Accordingly, when the piston cycle is reversed and displaces the inlet valve element (42) upwardly to close the inlet port the discharge valve element (42) is simultaneously displaced upwardly to permit flow into the piston chamber above the piston cylinder to be discharged through the outlet port (32). While the plug (64) and fitting (30) of this embodiment are shown to be threadedly engaged with the cylinder head (24), they as well may be non-threaded elements clamped or otherwise bolted and held in place within the cylinder head (24). Further, they may be sealed with suitable "O" rings or other means. Also, the inlet of fitting (30) may be through its side rather than out of its top, likewise the discharge of the outlet port (60)** could be upward. All of the above is intended to be possible in the described embodiment.

Figure 8:
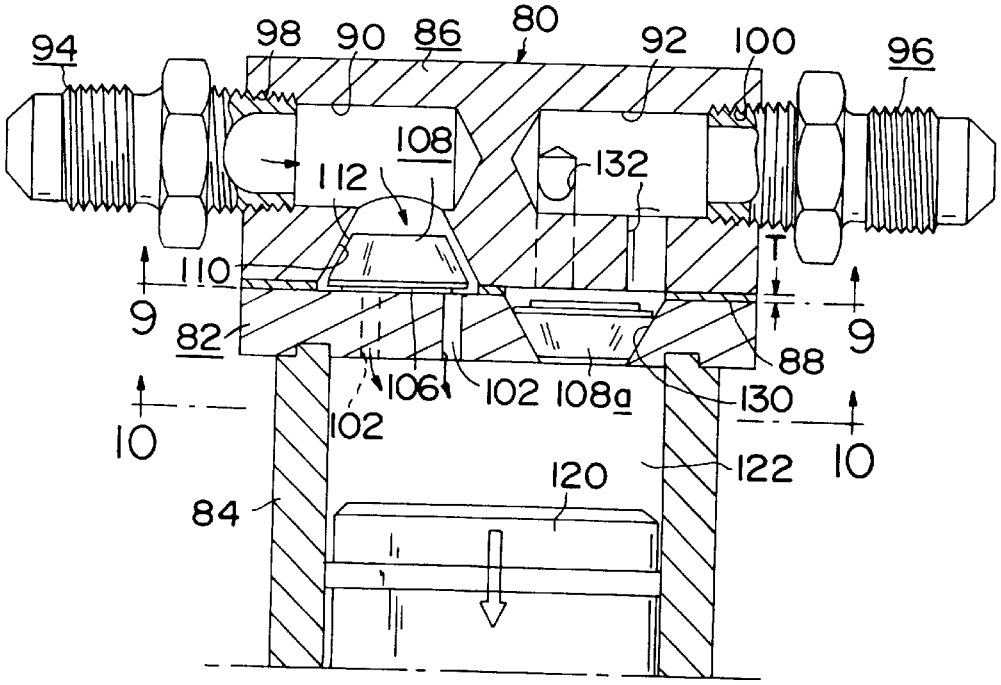
FIG. 8 is an enlarged fragmentary sectional elevational view similar to FIGS. 5 and 7 showing a modified two-piece head assembly with modified inlet and outlet port configurations.
Figure 9:
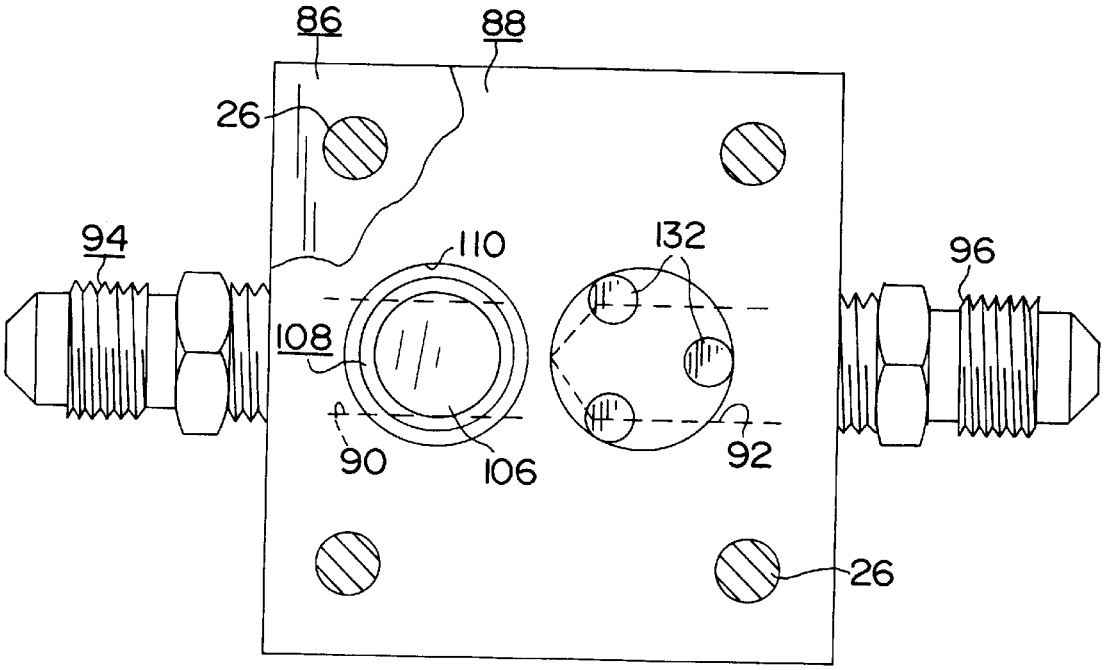
FIG. 9 is a bottom sectional plan view taken on lines 9—9 of FIG. 8 showing details of the inlet and outlet ports of the upper block and gasket.
Figure 10:
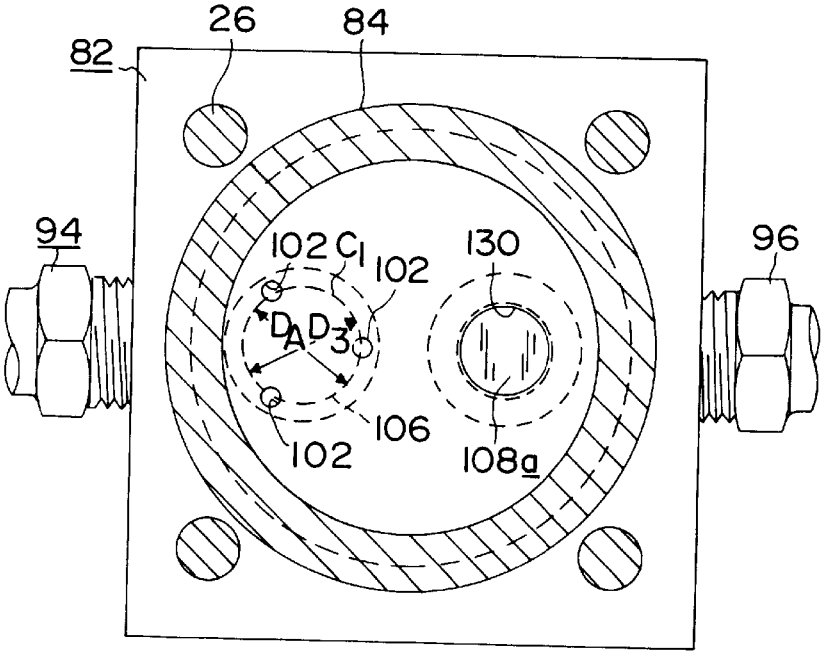
FIG. 10 is a bottom sectional plan view taken on lines 10—10 of FIG. 8 showing details of the inlet and outlet ports of the lower block.

There is illustrated in FIGS. 8–10 inclusive another embodiment of these valve assemblies in accordance with the present invention, especially adapted for compressors and the like. The compressor details are essentially the same as that described previously and accordingly similar reference numerals have been applied. However, in the present instance, the cylinder head (80) is a two-piece assembly comprising a lower base member (82) mounted at the upper end of the piston cylinder (84) and a cap element (86). A seal is mounted at the interface of the base and cap elements of the cylinder head. The figures show this seal to be a gasket or shim type seal of predetermined thickness, however, the design could be configured to use suitable "O" ring seals located in suitable "O" ring seal grooves or other suitable sealing means.

In the present instance, inlet and outlet ports (90) and (92) are formed in the sidewall of the cap element (86) which extends radially inwardly toward one another. Inlet and outlet fittings (94) and (96) engage in tapped openings (98) and (100) in the inlet and outlet ports and extend radially in diametrically opposed directions. Lines can be connected to these fittings connecting the compressor as in the previously described embodiment. The base member (82) as best illustrated in FIG. 10 has a series of circumferentially spaced axially extending through outlet holes (102) located on the circumference of a circle $C_1$ having a diameter $D_3$ somewhat greater than the diameter $D_4$ of the pad (106) of the valve element (108). The cap (86) has a chamber communicating with the inlet port (90) having a frusto-conical sidewall (110) complementing the tapered sidewall (112) of the valve element (108) and spaced therefrom a predetermined distance to permit flow when the valve is in a open or seated position shown in FIG. 8.

By selectively dimensioning the various parts, the clearance and the amount of axial displacement of the valve element can be selectively chosen depending on the flow characteristics sought. When the piston (120) is moving downward as shown in FIG. 8, flow into the piston chamber (122) is as indicated by the flow arrows in FIG. 8. It is noted that in this position the pad (106) does not close the axial through holes (102) and permits flow when the valve element (108) is in a downward position seated against the upper face of the lower base member (82) of the cylinder head.

Figure 7:
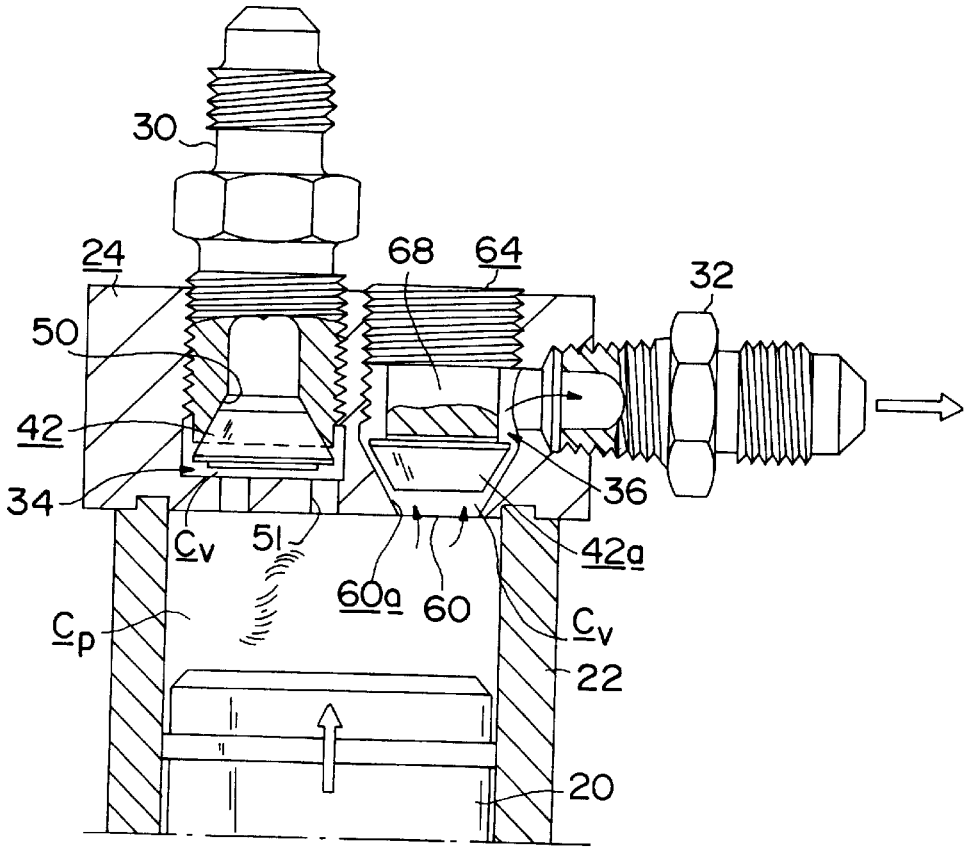
FIG. 7 is a view similar to FIG. 5 but showing the position of the inlet and outlet disk valves during the exhaust or upward stroke of the piston.

The discharge valve element ($108_a$) is inverted and seats in a frusto-conical tapered valve seat (130) adjacent the inlet through holes (102) as shown in FIGS. 7 and 8. The discharge port (92) is connected through a series of axial through holes (132) in the upper block (86) to the discharge port chamber (92). When the piston (120) is reversed and is in its upward moving discharge stroke, increased pressure in the piston chamber (122) displaces the valve element (108) upwardly to close flow and displaces the valve element ($108_a$) upwardly to allow flow through ports (132) and into communicating discharge port (92). The relative advantage of the two-piece head assembly or the single block assembly is principally an economic one depending upon manufacturing and assembly cost conditions present. A technical advantage of the single block is that it can transfer and dissipate heat more effectively than the two-piece assembly.

Figure 11:
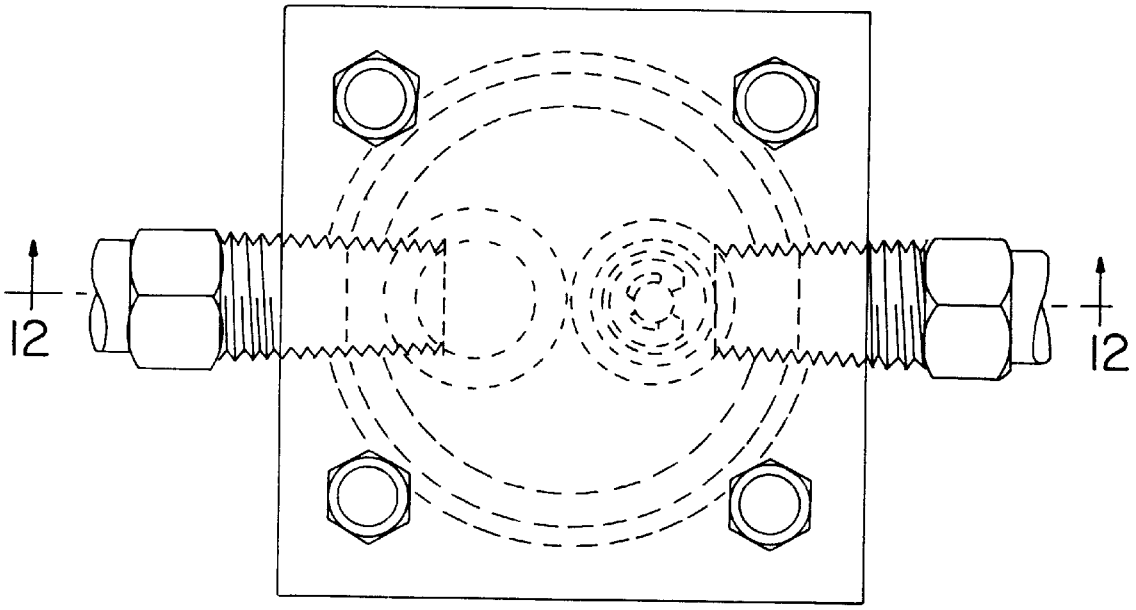
FIG. 11 is an enlarged fragmentary sectional elevational view similar to FIG. 7 but illustrating a modified truncated disc valve and cylinder head valve chamber.
Figure 12:
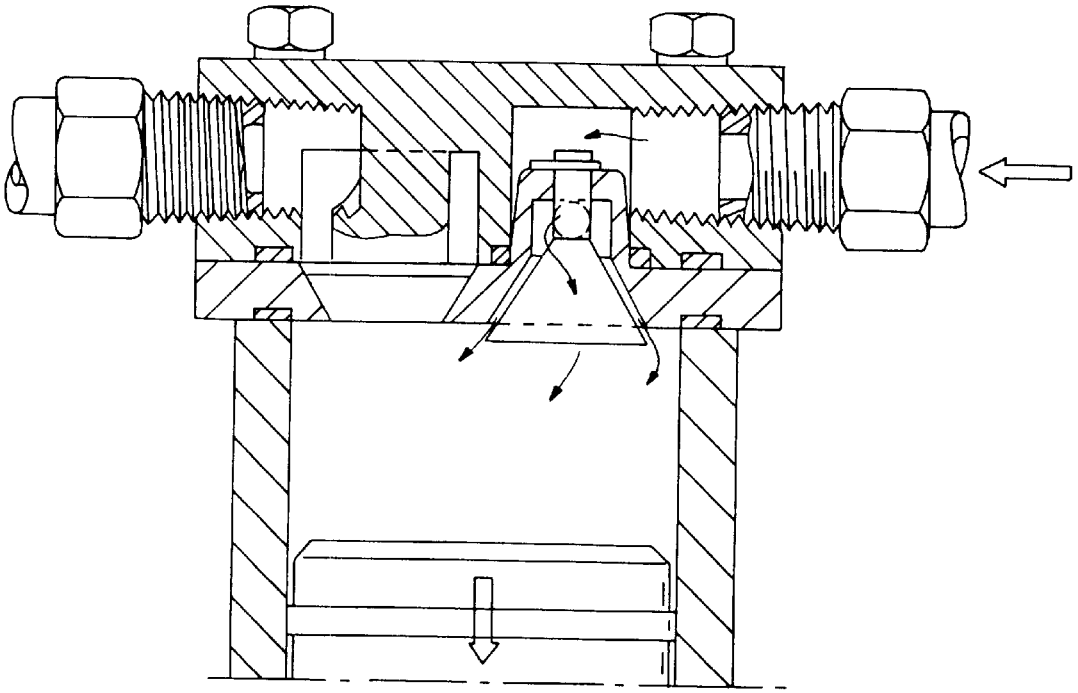
FIG. 12 is a fragmentary sectional plan view taken on the line 12—12 of FIG. 11 showing additional details of the modified valve chamber in the cylinder head.

There is illustrated in FIGS. 11–12 another embodiment of valve assembly in accordance with the present invention. The overall arrangement of the valve assembly is generally similar to that described previously. Thus, the valve element (140) consist of a truncated conical body portion (142) which in this instance has a flat base (146). The valve element as in the previously described embodiments is preferably made out of plastic material to contribute to the quick action produced by the designs of the present invention. In the present instance, the upper face of the head wall (150) has a disc-like pad (152) disposed centrally of the ports (154) in the piston chamber $C_p$. The height of the pad (152) is preferably about one-sixth (⅙) the height of the body portion of the valve element. Accordingly, when the piston (20) moves downwardly to create a reduced pressure in the piston chamber $C_p$, the valve element (140) is displaced downwardly to engage the disc-like projection (152) and provide a clearance around the periphery of the valve element to allow flow of gas/liquid. As noted previously, the valve element (140) is designed to substantially fill the valve chamber $C_v$ defined by the tapered valve seat (160) and the head wall, therefore the valve chamber minimizes dead space to enhance compression ratio and volumetric performance. The valve is a quick acting and has preferably a small valve displacement of less than about ten percent (10%) of the largest valve diameter in a vertical direction between open and closed positions. The valve is essentially self centering in the valve chamber $C_v$ without the aide of guide means, such as springs and the like.

On the outlet side of the system, the lower face of the depending stem (168) of the plug (170) confronts the lower face ($146_a$) of the valve element ($140_a$) and serves as a stop when the valve is actuated to an open position as illustrated in FIG. 11.

Even though particular embodiments of the present invention have been illustrated and described herein, it is not intended to limit the invention and changes and modifications may be made therein within the scope of the following claims.

What is claimed is:

1. A valve assembly comprising:

a valve chamber having an inlet and an outlet defined by a circumferentially extending tapered wall defining a valve seat adjacent the inlet and a wall with at least one port adjacent said outlet;

a valve element positionable between open and closed positions in response to pressure differentials only said valve element having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and a plurality of outlet ports arranged in a circular array and wherein the valve element is generally circular and engages interiorly of the array of outlet ports when the valve is in an open position.

2. A head assembly for a compressor, pump comprising;

inlet and outlet valve assemblies;

at least one of said valve assemblies having a valve chamber having an inlet and an outlet defined by a circumferentially extending tapered wall defining a valve seat adjacent the inlet and a wall with at least one port adjacent said outlet;

a valve element in said valve chamber positionable between open and closed positions in response to pressure differentials only having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and at least one of said valve seats being formed on a fitting threadedly engageable in the head assembly axially therein so that the displacement of the valve assembly may be selectively varied.

3. A head assembly for a compressor, pump comprising;

inlet and outlet valve assemblies;

at least one of said valve assemblies having a valve chamber having an inlet and an outlet defined by a circumferentially extending tapered wall defining a valve seat adjacent the inlet and a wall with at least one port adjacent said outlet;

a valve element in said valve chamber positionable between open and closed positions in response to pressure differentials only having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and said inlet valve and outlet valve assemblies having fittings disposed transversely relative to one another.

4. A head assembly for a compressor, pump comprising;

inlet and outlet valve assemblies;

at least one of said valve assemblies having a valve chamber having an inlet and an outlet defined by a circumferentially extending tapered wall defining a valve seat adjacent the inlet and a wall with at least one port adjacent said outlet;

a valve element in said valve chamber positionable between open and closed positions in response to pressure differentials only having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and said head assembly comprises at least two head sections and wherein valve chambers are defined in the head sections in such a manner that the position of the sections can be adjusted relative to one another to thereby selectively vary the displacement of the valve element in the valve chamber.

5. A head assembly for a compressor, pump comprising;

inlet and outlet valve assemblies;

at least one of said valve assemblies having a valve chamber having an inlet and an outlet defined by a circumferentially extending tapered wall defining a valve seat adjacent the inlet and a wall with at least one port adjacent said outlet;

a valve element in said valve chamber positionable between open and closed positions in response to pressure differentials only having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and a plurality of outlet ports arranged in a circular array and wherein the valve element is generally circular and engages interiorly of the array of outlet ports when the valve is in an open position.

6. A compressor assembly compressing, evacuating or pumping gases and liquids from one location or source to another comprising;

a piston chamber;

a piston mounted in the piston chamber;

means for cycling the piston axially in the chamber;

a head assembly at one end of the piston chamber;

inlet and outlet valve assemblies in said head assembly for circulating gas or liquid through the piston chamber upon cycling of the piston;

at least one of said valve assemblies having a valve chamber having an inlet and outlet defined by a circumferentially extending tapered wall defining a valve seat adjacent the inlet and a wall with at least one port adjacent this outlet;

a valve element in said valve chamber positionable between open and closed positions in response to pressure differentials having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and at least one of said valve seats being formed on a fitting threadedly engageable in the head assembly axially therein so that the displacement of the valve assembly may be selectively varied.

7. A compressor assembly compressing, evacuating or pumping gases and liquids from one location or source to another comprising;

a piston chamber;

a piston mounted in the piston chamber;

means for cycling the piston axially in the chamber;

a head assembly at one end of the piston chamber;

inlet and outlet valve assemblies in said head assembly for circulating gas or liquid through the piston chamber upon cycling of the piston;

at least one of said valve assemblies having a valve chamber having an inlet and outlet defined by a circumferentially extending tapered wall defining a valve seat adjacent the inlet and a wall with at least one port adjacent this outlet;

a valve element in said valve chamber positionable between open and closed positions in response to pressure differentials having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position and said inlet valve and outlet valve assemblies having fittings disposed transversely relative to one another.

8. A compressor assembly compressing, evacuating or pumping gases and liquids from one location or source to another comprising;

a piston chamber;

a piston mounted in the piston chamber;

means for cycling the piston axially in the chamber;

a head assembly at one end of the piston chamber;

inlet and outlet valve assemblies in said head assembly for circulating gas or liquid through the piston chamber upon cycling of the piston;

at least one of said valve assemblies having a valve chamber having an inlet and outlet defined by a circumferentially extending tapered wall defining a valve seat adjacent the inlet and a wall with at least one port adjacent this outlet;

a valve element in said valve chamber positionable between open and closed positions in response to pressure differentials having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and said inlet valve and outlet valve assemblies having valve fittings which are aligned.

9. A compressor assembly compressing, evacuating or pumping gases and liquids from one location or source to another comprising;

a piston chamber;

a piston mounted in the piston chamber;

means for cycling the piston axially in the chamber;

a head assembly at one end of the piston chamber;

inlet and outlet valve assemblies in said head assembly for circulating gas or liquid through the piston chamber upon cycling of the piston;

at least one of said valve assemblies having a valve chamber having an inlet and outlet defined by a circumferentially extending tapered wall defining a valve seat adjacent the inlet and a wall with at least one port adjacent this outlet;

a valve element in said valve chamber positionable between open and closed positions in response to pressure differentials having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and said head assembly comprising at least two head sections and wherein valve chambers are defined in the head sections in such a manner that the position of the sections can be adjusted relative to one another to thereby selectively vary the displacement of the valve element in the valve chamber.

10. A compressor assembly compressing, evacuating or pumping gases and liquids from one location or source to another comprising;

a piston chamber;

a piston mounted in the piston chamber;

means for cycling the piston axially in the chamber;

a head assembly at one end of the piston chamber;

inlet and outlet valve assemblies in said head assembly for circulating gas or liquid through the piston chamber upon cycling of the piston;

at least one of said valve assemblies having a valve chamber having an inlet and outlet defined by a circumferentially extending tapered wall defining a valve seat adjacent the inlet and a wall with at least one port adjacent this outlet;

a valve element in said valve chamber positionable between open and closed positions in response to pressure differentials having a truncated frusto conical body portion and an outer peripheral tapered surface complementing the taper of the valve seat;

means adjacent said outlet positioning at least a portion of the base of the valve element from said wall to permit flow from the inlet through the outlet when the valve is in the open position; and a plurality of outlet ports arranged in a circular array and wherein the valve element is generally circular and engages interiorly of the array of outlet ports when the valve is in an open position.

* * * * *

UNITED STATES PATENT AND TRADEMARK OFFICE

CERTIFICATE OF CORRECTION

PATENT NO. : 5,897,305
DATED : April 27, 1999
INVENTOR(S) : Roddis

It is certified that error appears in the above-identified patent and that said Letters Patent is hereby corrected as shown below:

Delete figures 13, 14, & 15

Signed and Sealed this

Thirteenth Day of June, 2000

*Attest:*

Q. TODD DICKINSON

*Attesting Officer*

*Director of Patents and Trademarks*